US006279237B1

(12) United States Patent
Lüttgens

(10) Patent No.: US 6,279,237 B1
(45) Date of Patent: Aug. 28, 2001

(54) SHARPENER

(75) Inventor: Fritz Lüttgens, Erlangen (DE)

(73) Assignee: Kum Limited, Dublin (IE)

( * ) Notice: Subject to any disclaimer, the term of this patent is extended or adjusted under 35 U.S.C. 154(b) by 0 days.

(21) Appl. No.: 09/394,197

(22) Filed: Sep. 10, 1999

(30) Foreign Application Priority Data

Sep. 12, 1998 (DE) ..... 198 41 730

(51) Int. Cl.[7] ..... B43L 23/00
(52) U.S. Cl. ..... 30/454; 30/457
(58) Field of Search ..... 30/454, 451, 455, 30/457, 453

(56) References Cited

U.S. PATENT DOCUMENTS

| | | | | |
|---|---|---|---|---|
| 1,822,994 | | 9/1931 | Markowitz . | |
| 2,143,797 | | 1/1939 | Powell . | |
| 2,309,194 | | 1/1943 | Hutchinson . | |
| 2,366,928 | | 1/1945 | Paschell . | |
| 4,406,315 | * | 9/1983 | Brickhouse | 145/3.31 |
| 4,934,057 | * | 6/1990 | Chao | 30/457 |
| 5,167,071 | * | 12/1992 | Eisen | 30/452 |
| 5,379,817 | * | 1/1995 | O'Neil et al. | 30/454 |
| 5,774,995 | * | 7/1998 | Ross | 30/454 |
| 5,894,669 | * | 4/1999 | Luttgens | 30/452 |

FOREIGN PATENT DOCUMENTS

| | | |
|---|---|---|
| 30 41 313 C2 | 8/1982 | (DE) . |
| 38 12 252 C1 | 3/1989 | (DE) . |
| 39 52 586 C2 | 5/1991 | (DE) . |
| 0 078 512 A1 | 5/1983 | (EP) . |

* cited by examiner

*Primary Examiner*—M. Rachuba
(74) *Attorney, Agent, or Firm*—Herbert L. Lerner; Laurence A. Greenberg; Werner H. Stemer

(57) ABSTRACT

A sharpener (1) contains a housing (5) with a blade (13) which is screwed on said housing and forms a tangent to a hollow-conical region (6*b*) of a guide channel (6) for the pencil (2), said hollow-conical region adjoining a hollow-cylindrical region (6*a*), a bending edge (19) being formed in the process. In the fixed position, the blade (13) is subjected to bending stressing in that, with the outer end (14) of the blade (13) being guided beneath the housing-side protrusion (16), the inner end (18) of said blade is fixed on the housing (5), the blade (13) being bent about the bending edge (19) in the process. This thus provides particularly secure and space-saving blade fixing (12) at both ends.

9 Claims, 2 Drawing Sheets

SHARPENER

Figure 1:
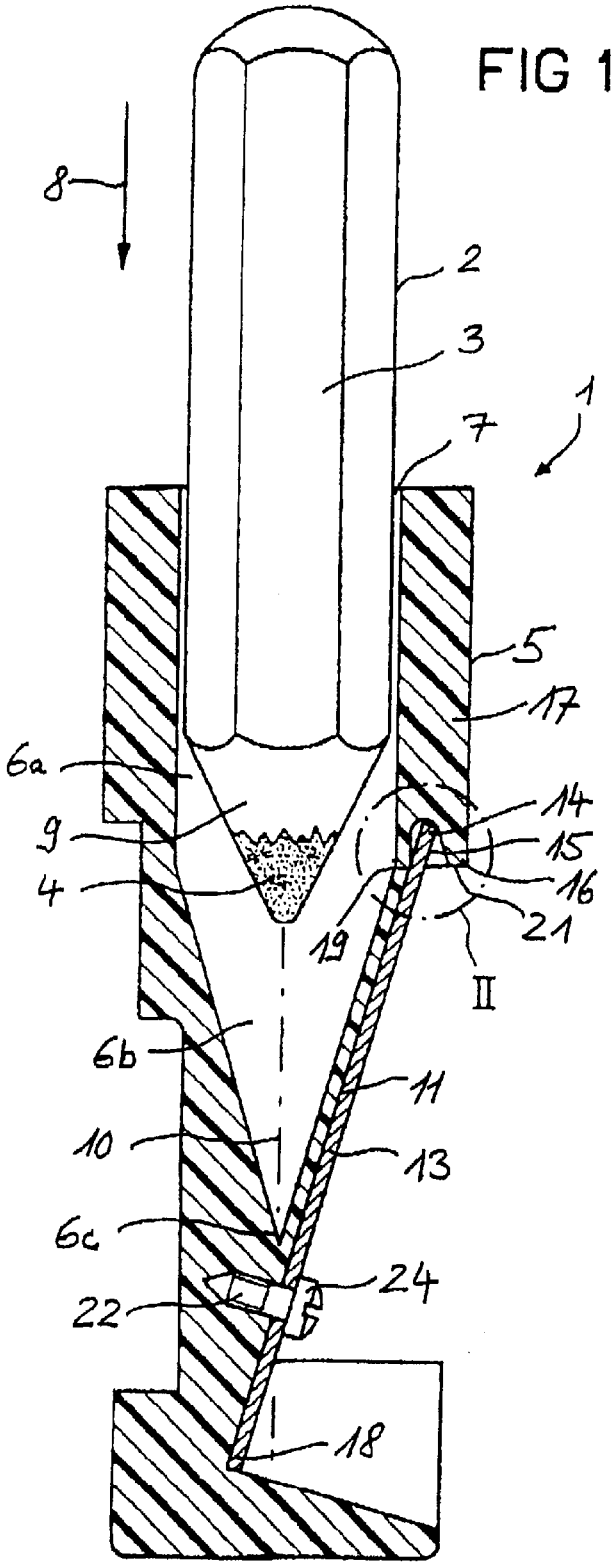

The invention relates to a sharpener having a housing and, in the latter, a guide channel into which an introduction opening for a pencil opens out, and having a blade which is fixed in the region of a housing abutment surface.

Such a sharpener is used, in particular, as a cosmetics sharpener for regenerating and shaping as desired the tip of a cosmetics pencil or core. Such cosmetics sharpeners are usually designed as so-called container-type sharpeners. For this purpose, a shaving-collecting cap, which serves for receiving the sharpening waste, is pushed or clipped onto that end of the housing which is located opposite the opening-mouth base or introduction opening for introducing the pencil. In the rest state, such cosmetics sharpeners are usually fixed, in the manner of a protective cap, on the use end of a cosmetics pencil or core in order also to protect the use end of the pencil, in particular its core, in relation to the surroundings when it is not in use. In the ideal case, the assembly comprising housing and possibly shaving-collecting cap fitted onto the housing thus has the outline of a protective cap, as is also used, for example with pencils for writing purposes, for covering the core tip when the pencil is not in use.

In the case of pencils for writing purposes, this protective cap is often also provided with a clip for attaching it inside a pocket, e.g. in the inside pocket of an item of clothing. Such attachment clips can also be used for cosmetics sharpeners which, when the pencil is not in use, assume the function of a protective cap for the core end. When not in use, cosmetics pencils are usually stored by the user in pockets, bags, cases or the like. It is particularly important in this case to protect the surroundings with respect to the use end or the core.

In this not-in-use state, however, it is desired for the sharpener to project as little as possible beyond the pencil or core in the radial direction in relation to the pencil or core axis. It is precisely in this direction that it is to be configured in as space-saving a manner as possible in order to be able to fulfill its function as a pencil cap, in the stored state, in an ideal, space-saving manner. This is problematic, however, in particular in terms of the design and fixing of the blade.

The blade required for such a sharpener usually consists of a metallic material, e.g. of a heat-treatment steel. The blade, which is normally in the form of an elongate shallow cuboid, is ground on one longitudinal flank for the purpose of forming a blade cutting edge. In a conventional and tried-and-tested manner, this blade is fixed centrally on the housing by means of a single screw. The screw passes through the blade in the region of a through-passage hole. The basic construction of such a sharpener with screwed-on blade is known from EP 0 078 512 A1.

However, a minimum screw diameter, which is necessary for strength reasons, requires a certain minimum width of the essentially shallow-cuboidal blade. Otherwise, the through-passage hole would result in the inherent strength of the blade being weakened to a considerable extent. It is precisely in the central region, i.e. in the through-passage region of the fixing screw, that the blade is subject to the highest stressing during the sharpening operation, since the highest cutting forces occur there. In the case of the usually wood-encased cosmetics pencils, this part of the blade is responsible for shaving away the wooden casing, which requires considerably higher cutting forces than the shaping of the core, which in the case of cosmetics pencils is usually of soft consistency.

On account of the blade which is used having a minimum width which is necessary for the central screwed fixing, a sharpener housing having a hollow-conical guide channel in the inner region has a space-related problem in the circumferential region of the cone foot if it is desired for the sharpener to be of a space-saving construction. This is because, in this region, the design means that the blade is of the same width as the central region provided with the screw-hole. For strength reasons, this is also desirable or necessary because the casing, of the usually wood-encased pencil, which is to be shaved in this central region produces the highest cutting pressure. Accordingly, the blade has to absorb the highest reaction pressure at this location. It would thus be helpful for the blade to be fixed as close to this location as possible, which, on account of the problems with space, is very difficult to achieve with the usually centrally arranged fastening screw if the abovementioned space-saving construction is desired.

If it is desired to minimize this space problem in the circumferential region of the sharpener by designing the blade at this location with flanks which converge at an acute angle, then this would mean, in turn, a weakening in the inherent strength of the blade and would not provide any fixing on the housing.

In the case of a design previously known from DE 38 12 252 C1 or DE 39 32 586 C2, screwless fixing of the blade on the housing takes place by the blade being at least partially integrally encapsulated by injection molding. A similar screwless design is known from DE 30 41 313 C2, in which the blade is clamped by the subsequent welding of a cover plate to the sharpener housing. However, these solutions for fixing the blade involve very high outlay in terms of production, in particular in terms of injection molding, and save only a small amount of space, if any at all.

The object of the invention is thus, with a simultaneously space-saving construction of the sharpener, to achieve an advantageous and secure method of fixing the blade on the housing.

This object is achieved according to the invention by the features of claim 1. For this purpose, there is two-point fixing of the blade at its two ends, i.e. two-ended blade fixing, and it is only in the region of the radially inner end of the blade, which is thus less problematic in terms of the space-related problem, that a separate fixing means, in particular a screw, is used as a fixing location. On account of the positioning, e.g. of a screwed connection, very close to the axis, there are no problems associated with accommodating the screw head within the casing region of the sharpener housing.

In contrast, in the region of the outer end of the blade, said end being in the vicinity of the introduction opening for introducing the pencil, the blade is clamped on the housing itself without a separate, additional fixing means, such as a screw, which would have its head projecting in a disruptive manner beyond the circumference of the sharpener housing. In this location, the blade has its outer end clamped behind a housing-side protrusion. This takes place by bending stressing being produced when the inner end of the blade is fixed, in that, in the region of the outer end, said blade is guided about a bending edge at the transition between a hollow-cylindrical region and a hollow-conical region of the guide channel.

EP 0 078 512 A1, which was mentioned in the introduction, does indeed describe a design of a sharpener in which the blade is secured at both ends, one blade end being inserted into a housing groove and the opposite blade end being secured on the housing by means of a screw. However, in the case of this known design, the blade is curved in a concave manner in the longitudinal direction, in relation to the sharpener housing, with the purpose of narrowing the guide channel, in that the cone angle, in relation to the center axis of a pencil which is to be sharpened, is smaller on the channel side which is directed towards the curved central region of the blade than the cone angle on the opposite channel side. Since the blade is thus subjected to negative prestressing, additional means are necessary for fixing the blade such that it is secured against displacement. In the case of the known sharpener, this is achieved by means of an adjustment screw of which the screw end is guided against the bearing side or abutment side of the blade curvature and thus, in addition to adjusting the curvature depth, presses the blade ends against the respective housing abutment surface. The process of fixing the blade in position such that it is secured against displacement, a bending edge being utilized in the process, is neither envisaged nor thought of in the case of this known sharpener.

The blade of the sharpener according to the invention is either planar or in order to produce positive prestressing—in relation to the housing bearing surface—curved in a convex manner in the initial state. By the elimination of central screwed fixing with a central through-passage hole necessarily being provided at this location, it is advantageously possible for the essentially shallow-cuboidal or convexly curved blade to be designed, without any reductions in stability, to be considerably narrower than is the case with conventional sharpener blades. This narrow design of the blade makes it easier to have a space-saving construction in the circumferential region of the housing.

The housing-side protrusion is expediently designed as an integral component of the housing and forms a receiving pocket in the process. Prior to the tightening of the fastening screw which acts on the longitudinal end of the blade in the interior of the housing—or inner end of the blade—said blade has its outer end merely pushed into the housing or receiving pocket essentially in the axial direction, approximately parallel to the longitudinal axis of the guide channel.

In an expedient configuration, the fixing screw, which passes through the inner end of the blade, is positioned in front of the cone tip of the hollow-conical channel region, and thus outside the guide channel, in a region which is necessarily at quite a distance from the circumferential casing of the sharpener housing. At this location, the screw head of the fixing screw, on the one hand, does not pose any space-related problems and, on the other hand, does not obstruct the undisrupted run-off of the shaving waste over the shaving surface of the blade. Moreover, there is sufficient housing material in this region for receiving a sufficiently long threaded hole for the fixing screw.

Figure 2:
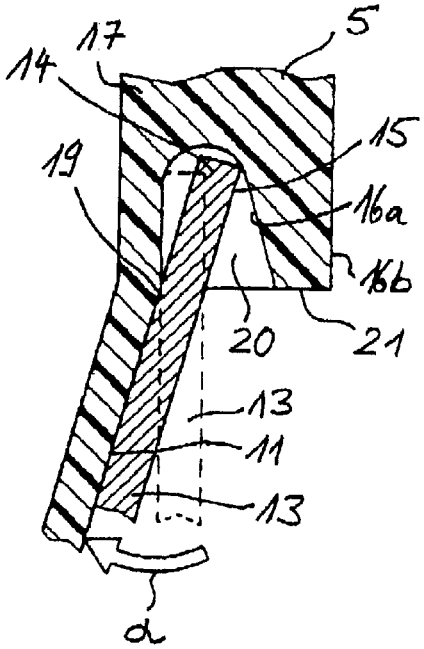
Figure 3:
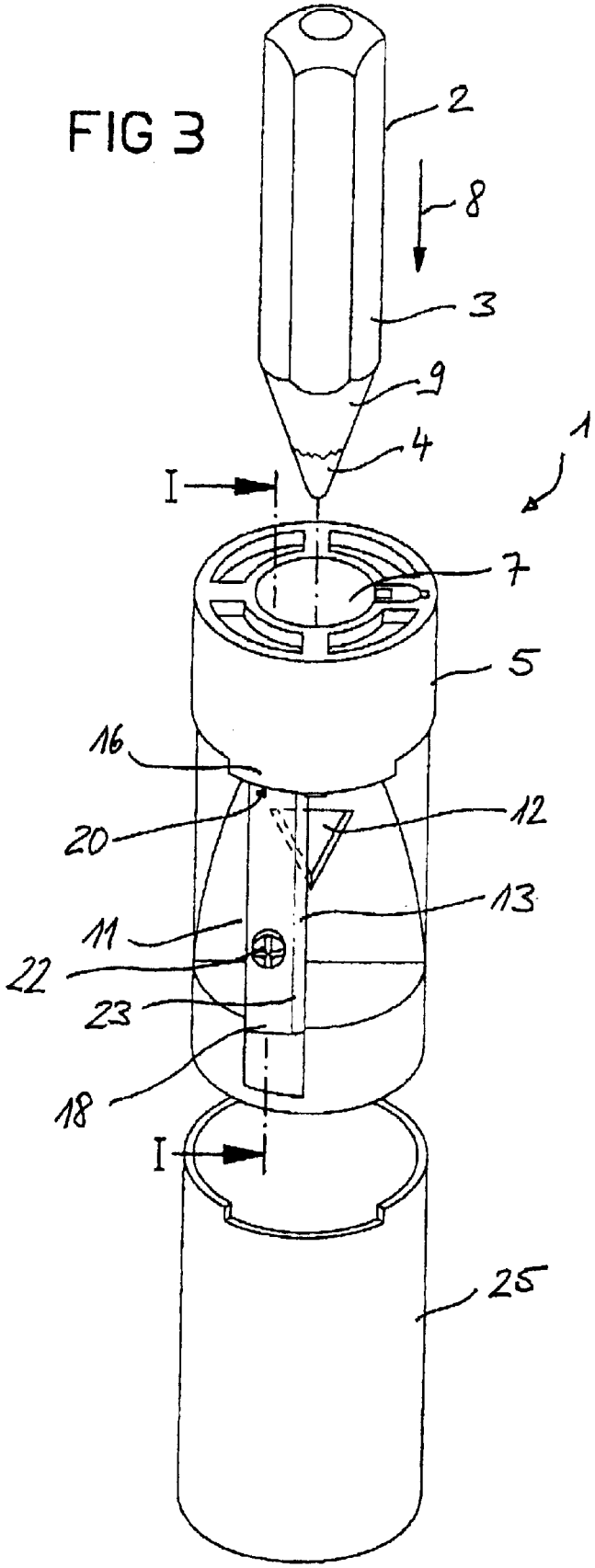

An exemplary embodiment of the invention is explained hereinbelow with reference to a drawing, in which:

FIG. 1 shows a longitudinal section, corresponding to the section line I—I in FIG. 3, through a sharpener with the blade fixed at both ends, FIG. 2 shows, on an enlarged scale, a detail II from FIG. 1 with the blade guided about a bending edge, and FIG. 3 shows an exploded illustration of the housing of a cosmetics sharpener with an associated shaving-collecting cap.

The sharpener 1 serves for sharpening a soft-core pencil 2 which contains a soft core 4 encased within a wooden casing 3. The sharpener 1 has a housing 5 with a guide channel 6 which is open at two locations. In this case, the pencil 2 can be introduced via an introduction opening or opening-mouth base 7. Adjoining the introduction opening 7 in the introduction direction 8, the guide channel 6 first of all has a hollow-cylindrical region **6*a* in which the case 3 of the pencil 2 is guided such that it can be rotated without obstruction. The actual guidance of the pencil 2, however, takes place in a front, hollow-conical region 6*b* which adjoins the hollow-cylindrical region 6*a* in the introduction direction 8 and of which the outline corresponds with the conical tip 9 of the pencil 2**.

In this hollow-conical region **6*b*, the guide channel 6 is likewise open, to be precise along a longitudinal flank which is inclined in the direction approximately of its center axis 10 and forms a housing abutment or housing bearing surface 11. Along the latter, the sharpener 1 contains a flank or housing opening 12 which corresponds with a blade 13 fixed in housing abutment (FIG. 3). In the fixed position, the blade 13 has its outer end 14 subjected to pressure, from its outside 15, by a housing-side protrusion 16. On its outside 16*b*, which is directed away from the side 16*a* which acts on the outer end 14 of the blade 13, the housing-side protrusion 16 forms part of the housing 5 or of the casing 17** thereof.

At the inner end 18, the blade 13 is screwed in abutment against the housing 5 such that the outer end 14 is pressed against the protrusion 16 from the inside. For this purpose, the housing-side protrusion 16 and the housing bearing surface 11 for the blade 13 are positioned such that, in the fixed position, the blade 13 is subjected to bending stressing. The bending stressing is produced by a bearing location or bending edge 19 which is formed on the outside of the guide channel 6, at the transition of the latter from the hollow-cylindrical region **6*a* to the hollow-conical region 6*b*. This can be seen comparatively clearly from FIG. 2. A receiving pocket 20 of the housing 5, said receiving pocket being open towards the bending edge 19, expediently encloses the outer end 14 of the blade 13 and forms the housing-side protrusion 16** along with an outer border.

A fixing screw 22 is positioned, in the longitudinal direction of the housing opening 12 flanking the blade 13, alongside the latter and eccentrically (FIG. 3) and in particular in front of the cone tip **6*c*, i.e. outside the guide channel 6 (FIG. 1). The blade 13 itself is then positioned alongside the center axis 10 and in this case partly conceals the housing opening 12 (FIG. 3), via which the shavings produced during sharpening of the pencil 2** drop out.

For blade fixing at both ends, first of all the blade 13 has its outer end 14 pushed beneath the housing-side protrusion 16. This is illustrated in FIG. 2 by the dashed blade contour. In this position, the blade 13 forms with the bearing surface 15 on the housing 5, said bearing surface being provided outside the protrusion 16, an acute angle a which may be very small. Pivoting the blade 13 in the direction of the housing bearing surface 11 and then fixing or screwing the inner end 18 of the blade 13 to the housing 5 produces the clamping pressure at the outer end 14 of the blade 13, with the result that the latter, in housing abutment between the two fixing points, is then subjected to bending stressing. This has a stabilizing effect over the entire length of the blade 13. In particular this two-point fixing at the two blade ends 14, 18 eliminates the stability-weakening through-passage hole which is necessary in the case of conventional sharpeners for the purpose of screwed fixing of the blade in the center. Also eliminated in the central region, which is important for the shaving or sharpening operation, is a screw head which disrupts the unobstructed run-off of the sharpening waste and projects beyond the shaving surface of the blade 13 and thus beyond the cutting edge of the blade.

The outer end 14 of the blade 13 is clamped by the fixing screw 22 being tightened. This causes slight pivoting of the blade 13 in a clockwise direction about its bearing location, formed by the bending edge 19, in the region of the outer end 14 beneath the protrusion 16. As the pivoting of the blade 13 in the clockwise direction about the bending edge 19, and thus about the bearing location of the outer end 14, increases on account of the fixing screw 22 being tightened, the clamping of the blade 13 beneath the protrusion 16 becomes more pronounced there. The screwed blade 13 then forms a tangent to the hollow-conical region 6*b* of the guide channel 6 for the pencil 2. In the case of the blade 13 which is curved in a convex manner in relation to the housing bearing surface 11, positive prestressing with the stabilizing action is maintained when the blade 13 is fixed.

With likewise just a single fixing screw 22, this results in two-point fixing of the blade 13, such that it is particularly secure against displacement, at its two ends 14, 18, where there is no obstruction of the run-off of shavings on the shaving surface 23 of the blade 13. The fixing screw 22 is countersunk in the interior of the housing 5 to such an extent that the screw head 24, rather than projecting radially beyond the housing casing 17, is at a large distance inside said housing casing, as can be seen clearly from FIG. 1.

FIG. 3 illustrates a shaving-collecting cap 25 which can be pushed onto the housing 5 in the direction counter to the introduction direction 8, and thus in the longitudinal direction of the sharpener 1. In the pushed-on position, the shaving-collecting cap 25 hermetically seals the circumferential region of the blade 13 in order to form a shavings chamber.

What is claimed is:

1. A pencil sharpener, comprising:

a housing, said housing having a housing-side protrusion and a guide channel, said guide channel having a hollow-cylindrical region formed therein and a hollow-conical region formed therein adjoining said hollow-cylindrical region;

a bending edge formed at the intersection of said hollow-cylindrical region and said hollow-conical region, said bending edge supporting fixation of said blade beneath said housing-side protrusion;

a fixing device; and a blade having an outer end and an inner end, said inner end disposed opposite said outer end, said blade retained on said housing by fixing said outer end beneath said housing-side protrusion and by fixing said inner end on said housing using said fixing device.

2. The sharpener according to claim 1, wherein said bending edge supports fixation of said blade beneath said housing-side protrusion by bending said blade.

3. The sharpener according to claim 1, wherein said hollow-conical region has a cone tip and said inner end of said blade is fixed outside said cone tip of said hollow-conical region of said housing, said cone tip being located opposite said bending edge.

4. The sharpener according to claim 1, further comprising a receiving pocket placed in contact with said housing, said receiving pocket being open toward the guide channel, enclosing said outer end of said blade.

5. The sharpener according to claim 1, further comprising a housing abutment surface in said hollow-conical region inclined in a direction of a center axis of said guide channel.

6. The sharpener according to claim 5, wherein said housing abutment surface has a flank opening.

7. The sharpener according to claim 1, further comprising a shaving-collecting cap which can be pushed onto said housing in a direction counter to an introduction direction for a pencil.

8. The sharpener according to claim 5, wherein said fixing device is a fixing screw.

9. The sharpener according to claim 8, wherein said fixing screw is positioned alongside said center axis.

* * * * *